US008904578B2

(12) United States Patent
Saunders et al.

(10) Patent No.: US 8,904,578 B2
(45) Date of Patent: Dec. 9, 2014

(54) MULTI-PIECE MATTRESS SUPPORTING FOUNDATION

(71) Applicant: Dreamwell, Ltd., Las Vegas, NV (US)

(72) Inventors: Craig Saunders, Rocky River, OH (US); Michael DeFranks, Decatur, GA (US); J. Evan Spirk, Gates Mills, OH (US); Lindsey Tufts, Eastlake, OH (US); Alex Velet, Westlake, OH (US); Stephen Hughett, Medina, OH (US); Gary R. Stephan, Seven Hills, OH (US); William E. Rabbitt, Chesterland, OH (US)

(73) Assignee: Dreamwell, Ltd., Las Vegas, NV (US)

( * ) Notice: Subject to any disclaimer, the term of this patent is extended or adjusted under 35 U.S.C. 154(b) by 186 days.

(21) Appl. No.: 13/656,815

(22) Filed: Oct. 22, 2012

(65) Prior Publication Data

US 2013/0098791 A1 Apr. 25, 2013

Related U.S. Application Data

(60) Provisional application No. 61/549,404, filed on Oct. 20, 2011.

(51) Int. Cl.
*A47C 19/02* (2006.01)

(52) U.S. Cl.
USPC ..... 5/200.1; 5/201; 5/285

(58) Field of Classification Search
USPC ..... 5/200.1, 201, 285, 400, 902
See application file for complete search history.

(56) References Cited

U.S. PATENT DOCUMENTS

| | | | | |
|---|---|---|---|---|
| 6,883,191 | B2 * | 4/2005 | Gaboury et al. | 5/201 |
| 2004/0055086 | A1 | 3/2004 | Owens | |
| 2009/0042003 | A1 | 2/2009 | Govang et al. | |
| 2011/0203050 | A1 * | 8/2011 | Rogers et al. | 5/285 |
| 2011/0271616 | A1 | 11/2011 | Rasmussen et al. | |
| 2011/0272856 | A1 | 11/2011 | Rasmussen et al. | |

FOREIGN PATENT DOCUMENTS

| | | | |
|---|---|---|---|
| DE | 1554014 | A1 | 10/1969 |
| DE | 8608282 | A1 | 7/1986 |
| ES | 2070061 | A2 | 5/1995 |
| FR | 2293897 | A1 | 7/1976 |

OTHER PUBLICATIONS

International Search Report and Written Opinion issued in International Patent Application No. PCT/US2012/061259, dated Jan. 17, 2013; 10 pages.

Notification Concerning Transmittal of International Preliminary Report on Patentability (Chapter 1 of the Patent Cooperation Treaty), issued in International Patent Application No. PCT/US2012/061259, dated May 1, 2014; 7 pages.

* cited by examiner

*Primary Examiner* — Fredrick Conley
(74) *Attorney, Agent, or Firm* — Cantor Colburn LLP

(57) ABSTRACT

Mattress foundations for supporting a mattress generally includes multiple support units that can be abutting arranged to for the mattress foundation. In one embodiment, the mattress foundation includes at least two support units in an abutting relationship that form a rectangular shape at each end of the mattress foundation and provide a planar support surface having length and width dimensions effective to support a mattress disposed thereon.

31 Claims, 7 Drawing Sheets

MULTI-PIECE MATTRESS SUPPORTING FOUNDATION

CROSS REFERENCE TO RELATED APPLICATIONS

This non-provisional application claims the benefit of U.S. Provisional Patent Application Ser. No. 61/549,404 filed Oct. 20, 2011, which is fully incorporated herein by reference in its entirety.

BACKGROUND

The present disclosure generally relates to support foundations for mattresses, and more particularly, to multi-piece mattress foundations.

Mattress supporting foundations for conventional box springs are often typically constructed of a combination of materials, including wood, metal, and fiber with a cloth outer cover and may include support sub-assemblies such as edge-reinforcing springs. The conventional box springs are large and heavy. They require considerable storage space and therefore are expensive in stocking in inventory, especially in different sizes; and they have a high cost for transporting them from the factory to the customer or mattress manufacturer. Improvements are always sought in the expense of manufacturing, handling, assembling, and transporting bed foundations, and in the quality of the end product. The size and number of materials, typically selected for low cost, present numerous difficulties for consumers, including handling and disposal. In fact, many U.S. states have instituted disposal fees for mattress foundations, which can be as high as $100.00.

BRIEF SUMMARY

The present disclosure is directed to multi-piece mattress foundations and support units for forming the mattress foundation. In one embodiment, a multi-piece mattress foundation for supporting a mattress comprises at least two support units in an abutting relationship that form a rectangular shape at each end of the mattress foundation and provide an elevated planar support surface having length and width dimensions effective to support a mattress disposed thereon, wherein the multi-piece mattress foundation is free of springs.

In another embodiment, the multi-piece mattress foundation for supporting a mattress comprises at least two support units in an abutting relationship that form a rectangular shape at each end of the mattress foundation and provide a planar support surface having length and width dimensions effective to support a mattress disposed thereon, wherein each support unit comprises opposing end units and a planar surface support extending therebetween, wherein each of the opposing end units comprises a quadrilateral shape.

A support unit for a mattress foundation comprises a first end unit comprising a quadrilateral cross sectional shape; a second end unit spaced apart from the first end unit that is a mirror image of the first end unit; and a planar surface support extending between the first and second end units and configured to provide an elevated support surface for supporting a mattress, wherein the first and second end units are spaced apart at a distance about equal to a length dimension of a mattress to be disposed on the mattress foundation when assembled.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Disclosed herein are multi-piece foundations for mattresses. The multi-piece foundations include at least two support units that can be abuttingly arranged to provide a planar support surface having a width and length similarly dimensioned to a mattress supported by the multi-piece foundation. Each of the support units includes end units and planar surface supports bridging the end units. The end units can generally have a cross-sectional quadrilateral shape that in combination with the planar surface supports elevate as well as support a mattress disposed thereon. Advantageously, each support unit can be configured to provide a minimal footprint prior to assembly, thereby minimizing storage space related to stocking in inventory, especially in different sizes. Moreover, because the support units themselves are defined by multiple pieces that are easily stacked, transportation costs from the factory to the customer or mattress manufacturer are reduced. Likewise, space can be minimized when shipped via delivery trucks, containers, and the like. Still further, many of the same components of the support units can be used to assemble more than one differently sized mattress foundations as will be discussed in greater detail below, which further reduces costs associated with manufacturing and reduces inventory as well as storage requirements. Finally, it should be apparent that the proposed mattress foundations are free of springs and can be free of an outer cloth cover as is generally employed in conventional box springs.

Figure 1:
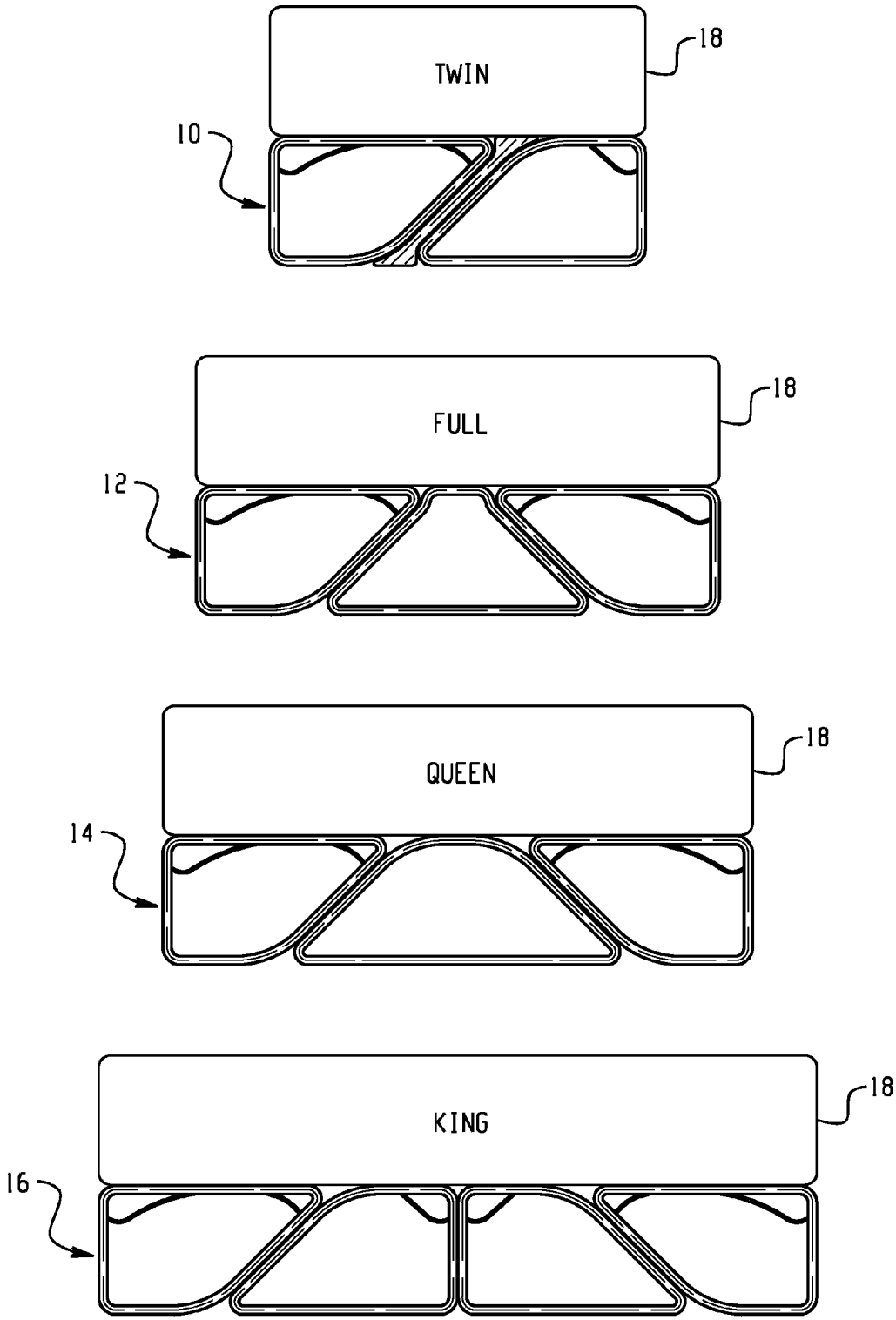
FIG. 1 depicts end on elevational views of differently sized mattress and mattress foundation assemblies in accordance with the present disclosure.

Referring now to FIG. 1, there are depicted various end-on views of differently sized multi-piece mattress foundations 10, 12, 14, and 16 composed of multiple support units in accordance with the present disclosure that are configured to support different sized mattresses 18. The particular mattresses and the particular foundations are not intended to be limited and may be of any size. For example, the components of the multi-piece foundations can be provided to form twin, full or double, queen and king size bed foundations, 10, 12, 14, and 16, respectively. Although these particular mattresses and mattress foundations are generally standardized in the United States in accordance with the International Sleep Products Association Voluntary Dimensional Guidelines for Bedding Product published in 2001, it should be apparent that the multi-piece mattress foundations can be utilized in non-standard sizes such as, for example, extra long (XL) versions of the above as well as the different standard and custom sized mattresses employed in countries outside of the United States. Moreover, each twin, full, queen, king full sized mattresses and foundations can vary individually in terms of size, typically on the order of a few inches.

Figure 2:
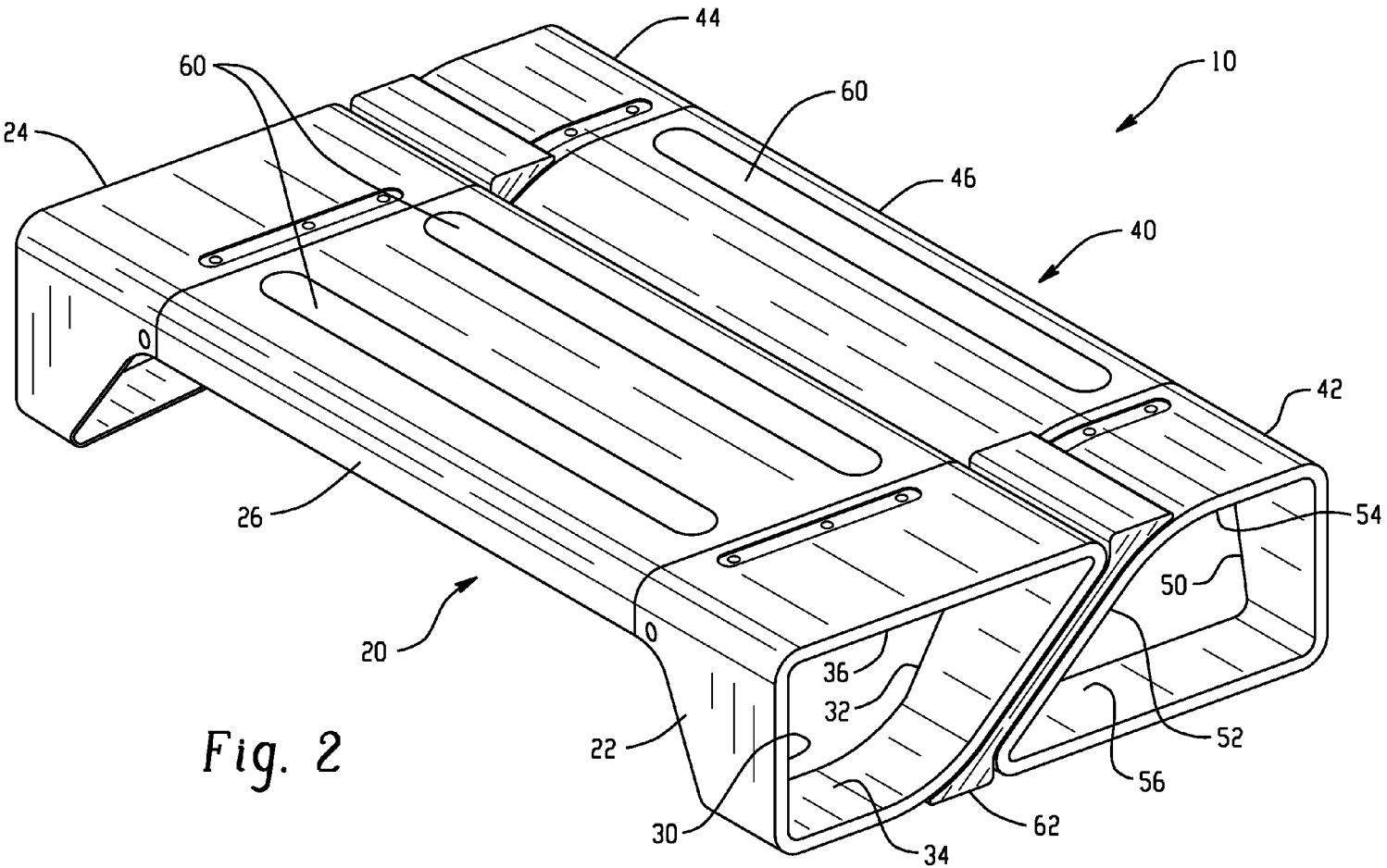
FIG. 2 is a perspective view of a multi-piece twin sized mattress foundation in accordance with the present disclosure.

Referring now to FIG. 2, there is depicted a multi-piece foundation 10 dimensioned to support a mattress (not shown) commonly referred to as twin sized, which generally refers to a length of about 74 inches and a width of about 38 inches. The multi-piece twin sized foundation 10 for supporting the twin sized mattress includes two abuttingly arranged support units shown generally at 20, 40, each support unit including a pair of end units 22, 24 and 42, 44 and a planar surface support 26 or 46, respectively, that collectively serve as the primary mattress support surface extending therebetween, wherein each respective pair of end units 22, 24 and 42, 44 are mirror images of one another and planar surface supports 26 and 46 are at the same length but have varying widths. The sum of the widths of planar surface supports 26 and 46 and the length between each respective pair of end units 22, 24 and 42, 44 are of similar dimensions to the twin size mattress disposed thereon.

Each end unit 22, 24, 42, 44 has four planar surfaces that generally form a cross-sectional quadrilateral shape. In one embodiment, the end units have a trapezoidal cross sectional shape, wherein the geometry and dimensions of the trapezoidal cross sectional shape are substantially the same for each pair of end units albeit mirror images of one another. End unit 22 includes a vertical sidewall 30, an angled sidewall 32 relative to the vertical sidewall 30, and parallel support walls 34, 36 extending therebetween. End unit 24 is a mirror image of end unit 22 and includes a vertical sidewall 30', an angled sidewall 32' relative to the vertical sidewall 30', and parallel support walls 34' and 36' (as shown more clearly in FIG. 4). End unit 42 includes a vertical sidewall 50, an angled sidewall 52 relative to the vertical sidewall 50, and parallel support walls 54, 56 extending therebetween. End unit 44 is a mirror image of end unit 42. Parallel support walls 36 and 56 have a greater length than parallel support walls 34 and 54, respectively.

During assembly of the twin-sized foundation 10, the support units 20, 40 are positioned such that the vertical sidewalls, e.g., 30 and 50, of each respective pair of end units 22, 24 and 42, 44 are oriented to define an exterior vertical wall of the foundation 10, and the angled sidewalls, e.g., 32 and 52, of each respective pair of end units 22, 24 and 42, 44 face an interior region of the foundation and abut one another. The planar surface support 26 of support unit 20 is configured to span between the end units 22 and 24 to define a portion of an upper surface for elevating and supporting the twin mattress relative to ground.

The width of the planar surface support 26 is about equal to the length of the parallel support wall 36 of the end unit 22. Similarly, the planar surface support 46 of support unit 40 is configured to span between the end units 42 and 44 to define a portion of the upper surface for elevating and supporting the twin mattress relative to ground. The width of the planar surface support 46 is about equal to the length of the parallel support wall 54 of the end unit 42. In this regard, the corresponding upper portion of each end unit (e.g., support wall 36 of end unit 22 and support wall 54 of end units 42 may include a flange (see, for example, FIG. 6) for securement to a recessed shoulder portion of the planar surface supports 26, 46, respectively, to form the respective support unit 20, 40. The sum total of the width provided by these planar surface supports 26 and 46 is about equal to the width of the twin-sized mattress disposed thereon. In this manner, the support units 20 and 40 can be abuttingly arranged to collectively form a rectangular shape at each end of the foundation 10 and include a planar surface extending and supporting the entire width and length of a mattress disposed thereon.

In some embodiments, the planar surface supports 26 and 46 further include a slip resistant coating and/or pad 60 disposed on an upper surface and is positioned to be in contact with the mattress when disposed thereon. Alternatively, the planar surface support can have a textured surface. In still other embodiments, the planar support surface can include one or more openings to provide improved airflow to the overlying mattress. The size and shape of the openings are not intended to be limited.

The quadrilateral shape of the various end units 22, 24, 42, and 44 can have arcuate-shaped corners as shown. When arcuate-shaped corners are present in this and the various embodiments discussed below, an optional spacer member 62 may be disposed between abutting support units 20, 40 to minimize a gap that may be formed therebetween and provide greater stability as well as additional support. The spacer member 62 can generally have an S-shape so as to fill the gaps at the ground level and/or within the planar surface of the abutting support units 20, 40. In other embodiments, the spacer member is disposed along a length of top surface of the mattress and has a shape generally conforming the space formed by the abutting support units.

The various pieces defining a support unit, e.g., end units 22, 24, and planar surface support 26, can be fixedly coupled to one another by fastener, adhesive, frictional engagement of the pieces themselves, combinations thereof, or the like to form the respective support unit. In this as well as the various embodiments that follow, each support unit 20 or 40 can be of a single unitary construction.

The support units as well as the optional spacer member 62 can be formed of any material such as wood, metal, plastic, glass, combinations thereof, and the like. In one embodiment, the components defining the support units and spacer member are formed of an extruded or assembled plastic; molded plastic; recyclable plastic; plastic reinforced with metal core, metal fiber, glass fiber, carbon fiber, resin or a combination of these. Those of ordinary skill in the art would know that various types of plastics can be used in the mattress foundation including but not limited to polyurethane, polyethylene, polystyrene, polypropylene, and the like.

In one embodiment, the various components that define the mattress foundations are formed, in whole or in part, of a biocomposite resin. For example, the biocomposite resin can be formed of a soy-based resin such as those described in US Pat. Pub. Nos. 2011/0272856, 2011/0271616, and 2009/0042003, incorporated herein by reference in their entireties.

As will be described in greater detail below, the same complementary pairs of end units, e.g., 22, 24 and 42, 44 as well as the same planar surface supports 26 and 46 can be used in combination with at least one additional support unit to support larger width mattresses. In the event the length of the foundation is larger than that of the twin sized mattress, e.g., a twin XL mattress foundation having a length of about 79 inches as opposed to the typical standard twin foundation length of about 74 inches, a longer planar surface support can be readily employed with the same end units employed for the smaller length foundations. In this manner, larger sized foundations can be readily assembled using at least some of the inventory common to the different sized mattress foundations, which minimizes waste and provides a significant commercial advantage to the manufacturer. Moreover, because there are three different components that generally define a support unit, e.g., a pair of end units and a planar surface support, the planar surface supports can be readily stacked with one another prior to assembly to minimize space requirements during storage or transportation. Likewise, the end units can be readily stacked for storage and/or transportation prior to assembly. However, it should be apparent that the two abutting support units as described above may simply be fabricated with larger width and length dimensions to accommodate the different sized mattress foundations for supporting mattresses larger than the twin mattress described above.

Figure 3:
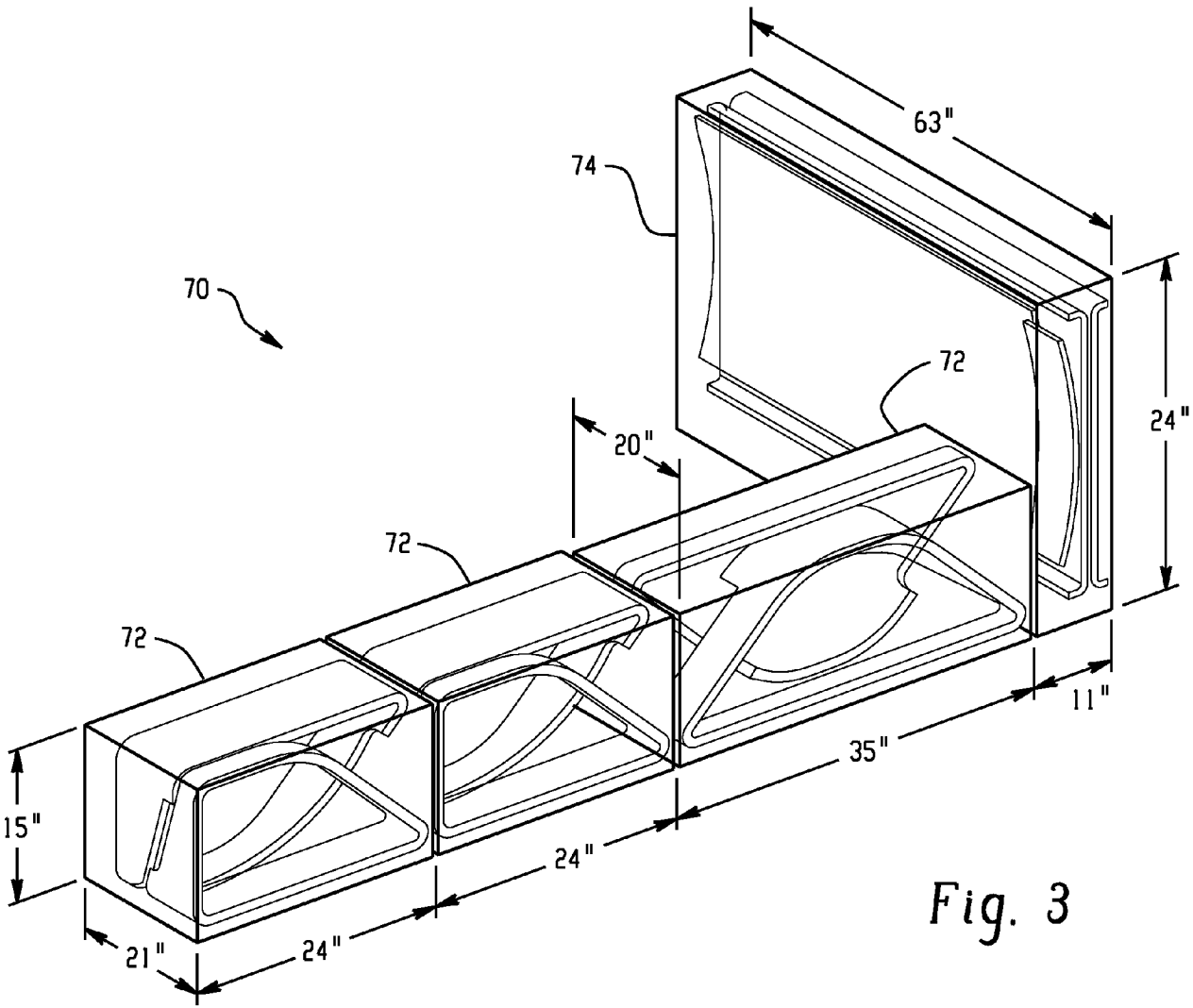
FIG. 3 provides a perspective view of an exemplary container arrangement for transporting a mattress foundation in accordance with the present disclosure.

Turning now to FIG. 3, there is depicted an exemplary storage arrangement 70 for shipment of a mattress foundation via an over the highway vehicle, e.g., a delivery truck. Each pair of end units for a particular support unit can be stacked against one another and packaged within a single container 72. Likewise, the planar supports can be stacked against one another and packaged within a different single container 74. As shown, the amount of space required for shipping the modular mattress foundation is relatively small. Moreover, by disposing pairs of end units and the planar support surfaces within single containers, and by carefully selecting the use of lightweight materials, the weight of each container is minimal and of a relatively small size so as to permit minimal effort in movement of the containers.

Figure 4:
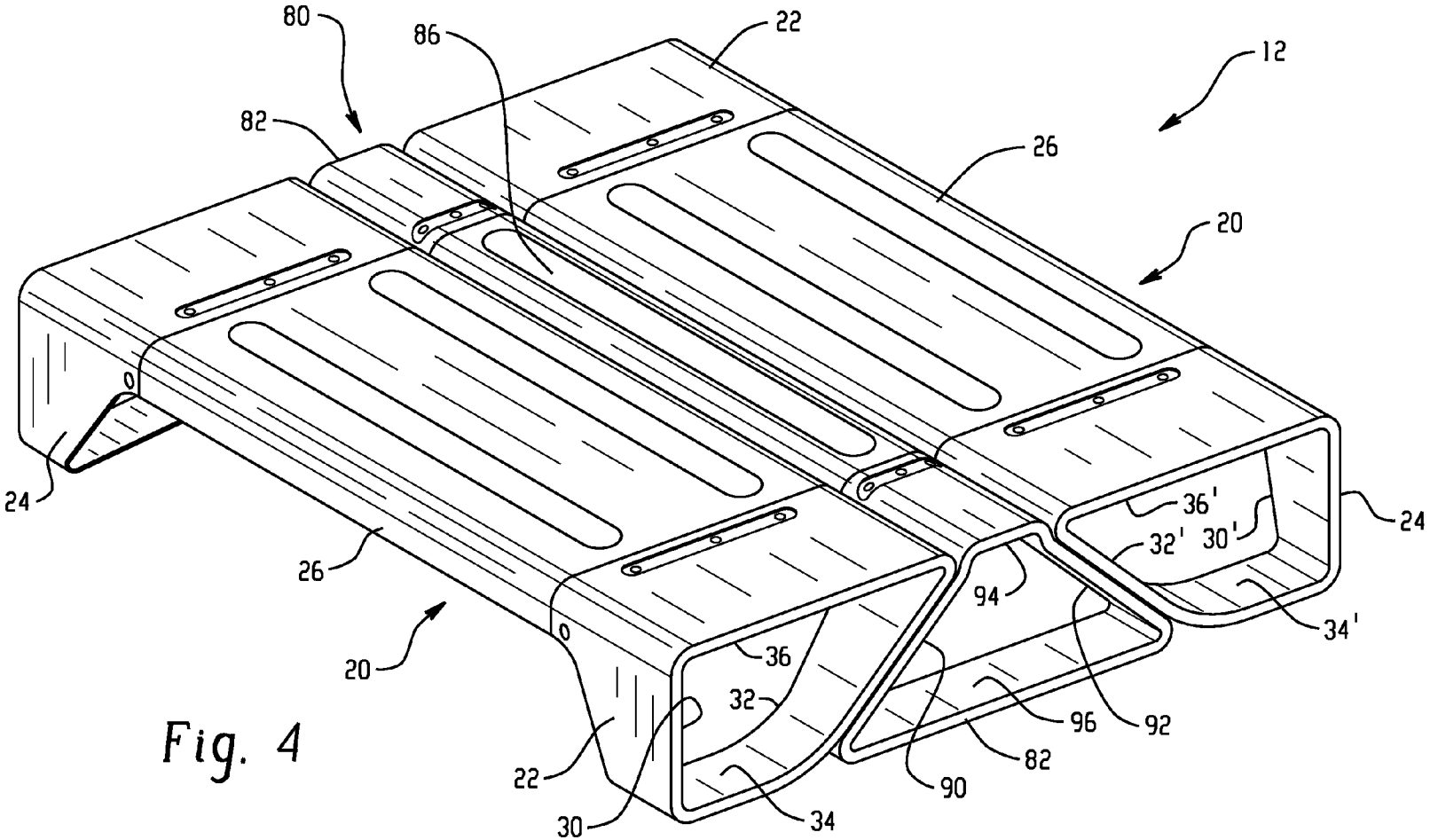
FIG. 4 is a perspective view of a multi-piece full sized mattress foundation in accordance with the present disclosure.

Referring now to FIG. 4, there is depicted mattress foundation 12, which is configured to accommodate a full sized mattress. The full sized mattress foundation has a greater width than the twin sized mattress foundation but typically has about the same length. For example, a typical full sized mattress foundation may have a width of about 53 inches and a length of about 74 inches, which has a similar length but is significantly wider than the dimensions of a standard twin sized mattress foundation. In this embodiment, the mattress foundation includes the use of two support units 20 and one additional support unit 80 intermediate and in abutment to the two support units 20 to collectively form a rectangular shape at each end of the foundation 12 and include a planar surface extending and supporting the entire width and length of the full sized mattress.

Support unit 80 includes a pair of end units 82 generally having an isosceles trapezoidal shape (one of which is shown) and a planar surface support 86 that extends between the two end units 82. Each end unit 82 includes angled sidewalls 90, 92, and parallel support walls 94, 96 extending therebetween. The length of parallel support wall 96 is greater than parallel support wall 94. Angled sidewall 90 is at an angle of about equal to 180 degrees minus the angle defined by parallel support wall 34 and angled sidewall 32 of end unit 22. Angled sidewall 92 is at an angle of about equal to 180 degrees minus the angle defined by parallel support wall 34' and angled sidewall 32' of end unit 24. In this manner, the two support units 20 and intermediate support unit 80 can be provided in an abutting relationship with minimal gaps in the planar surface defined by planar surface supports 26 and 86.

It should be apparent that in order to provide the abutting relationship and provide a width effective to accommodate the width of the full sized mattress, the orientation of the two support units 20 are end units 22 and 24 are provided at each end of the mattress foundation 12. As such, the mattress foundation 12 utilizes two planar surface supports 26 and one planar surface support 86. The width of planar surface support 86 and the width of the two planar surface supports 26 provide the mattress foundation 12 with an increase in width effective to compensate for the transition from the twin sized mattress to the full sized mattress. That is, the width of planar surface supports 26, 26, and 86 is equal to the width of the full sized mattress.

Figure 5:
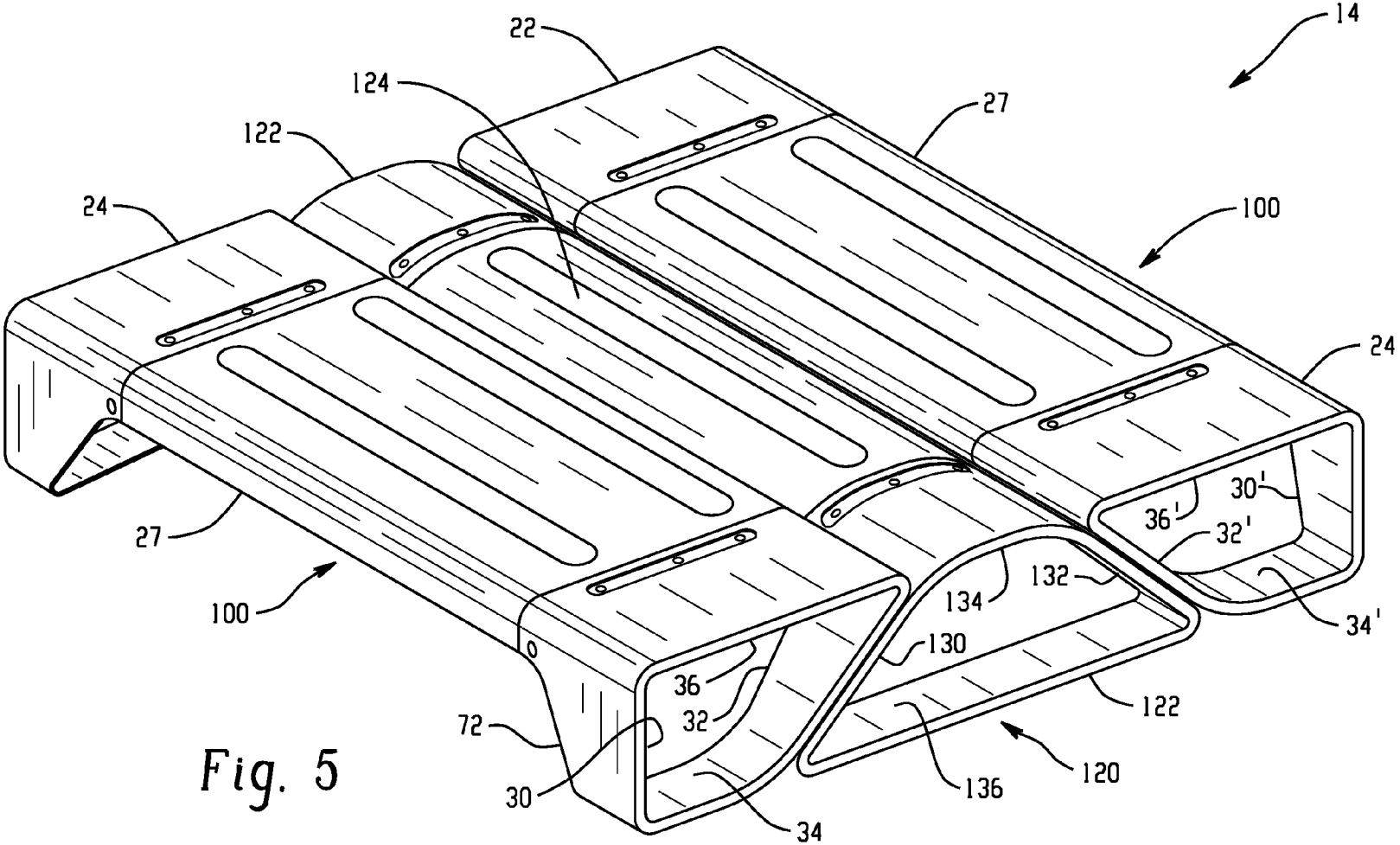
FIG. 5 is a perspective view of a multi-piece queen sized mattress foundation in accordance with the present disclosure.
Figure 6:
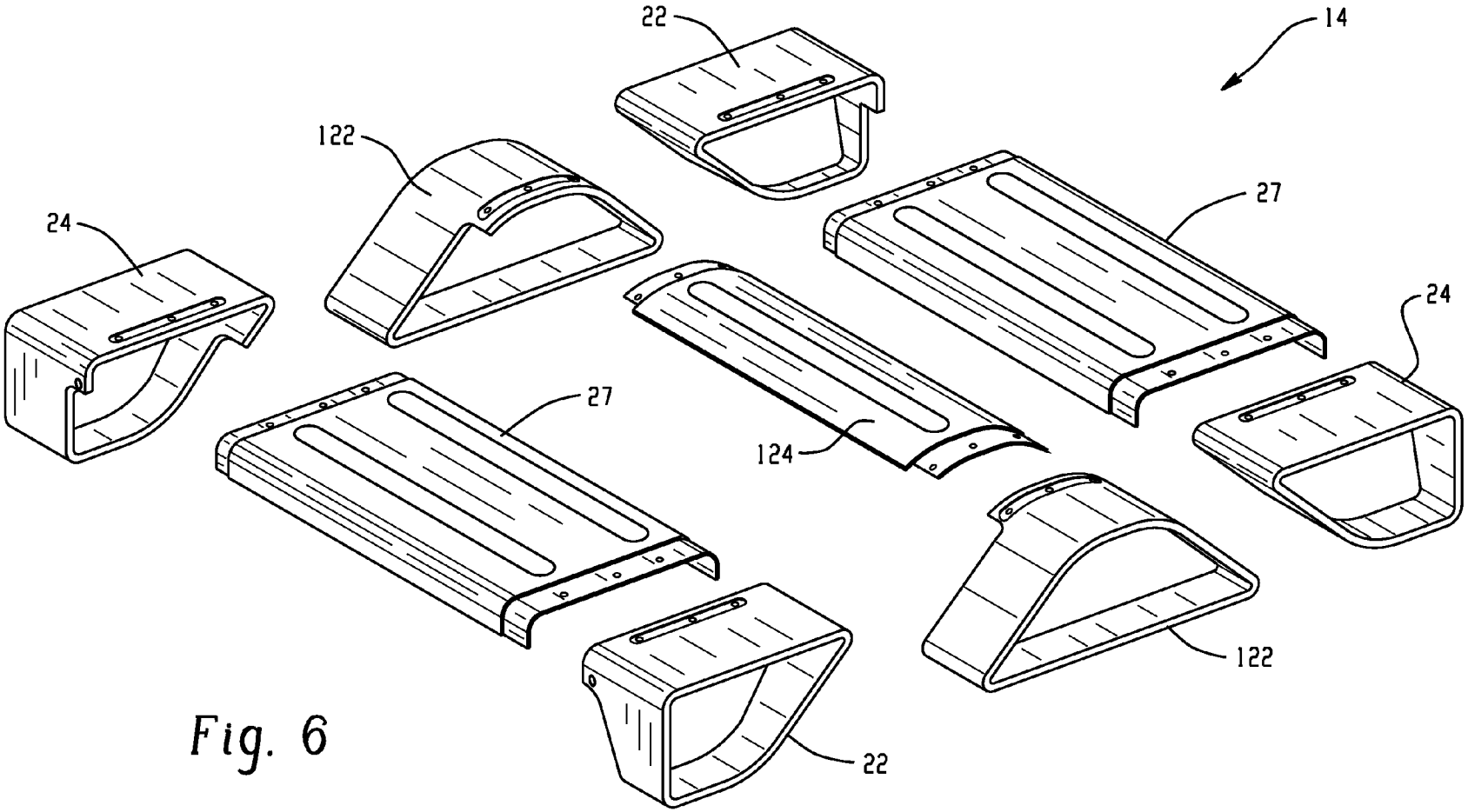
FIG. 6 is an exploded perspective view of the multi-piece queen sized mattress foundation of FIG. 5.

Referring now to FIGS. 5-6, there is depicted mattress foundation 14, which is configured to accommodate a queen sized mattress. The queen size mattress foundation 14 has a greater width and length greater than the width and lengths of the twin size and full size mattresses foundation previously described. For example, the queen sized mattress foundation may have a width of about 60 inches and a length of about 79 inches. Because the length is longer than a standard twin or full sized mattress foundation, a longer planar support surface is employed to compensate for the increased length. In this embodiment, the queen sized mattress foundation 14 includes two support units 100 defined by pairs of end units 22, 24 and planar support surface 27 and one support unit 120 intermediate and in abutment thereto to form generally a rectangular shape at each end of the foundation 14 and include a planar surface extending and supporting the entire width and length of a queen sized mattress disposed thereon Support unit 120 includes two of end units 122 generally having an isosceles trapezoidal shape and a planar surface support 124 that extends between the two end units 122. Each end unit 122 includes angled sidewalls 130, 132, and parallel support walls 134, 136 extending therebetween. Angled sidewall 130 is at an angle about equal to 180 degrees minus the angle defined by parallel support wall 34 and angled sidewall 32 of end unit 22. Angled sidewall 132 is at an angle about equal to 180 degrees minus the angle defined by parallel support wall 34' and angled sidewall 32' of end unit 24. In this manner, the two support units 100 and intermediate support unit 120 can be provided in an abutting relationship with minimal gaps in the planar surface defined by planar surface supports 27 and 124.

Figure 7:
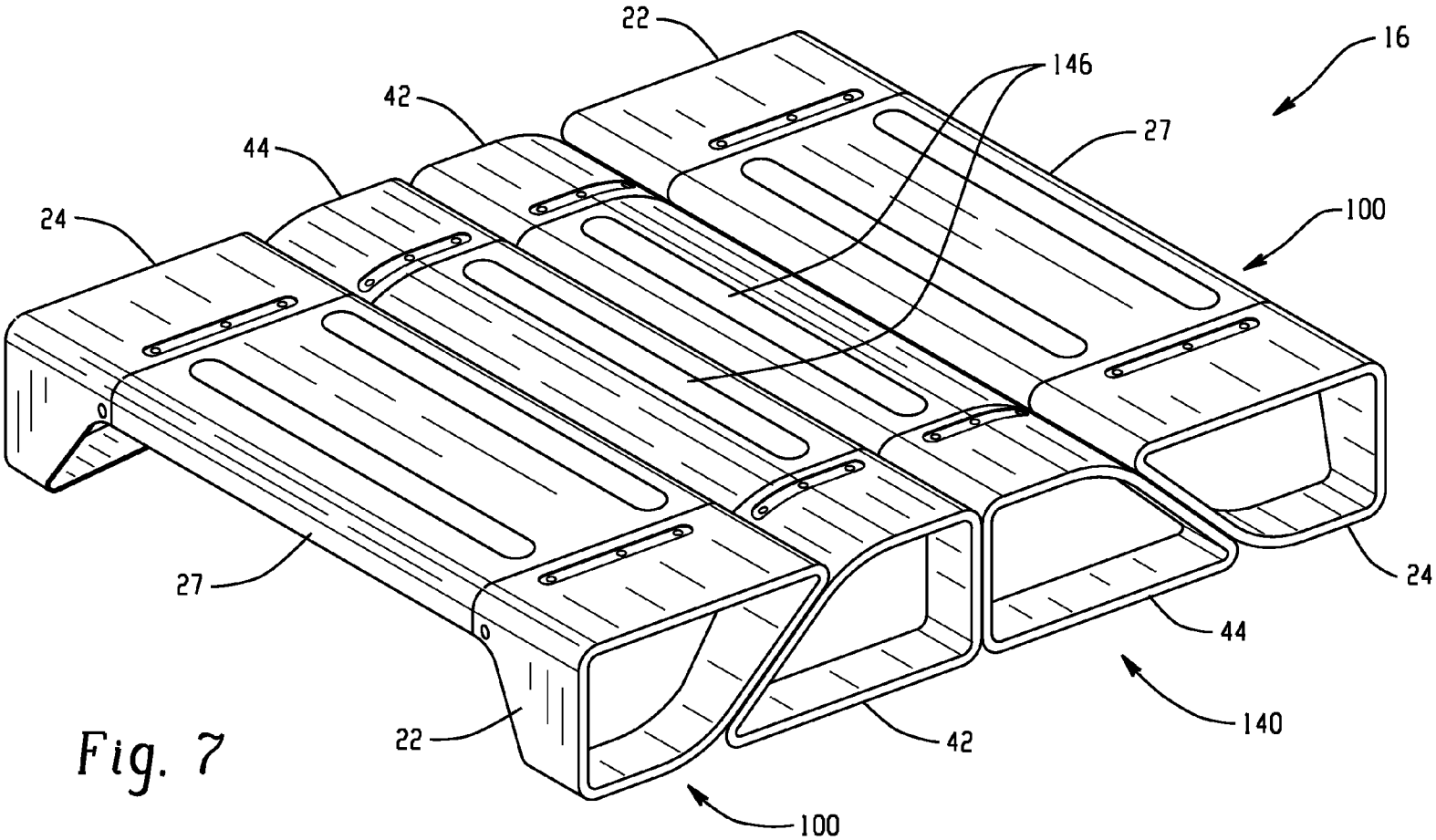
FIG. 7 is a perspective view of a multi-piece king sized mattress foundation in accordance with the present disclosure.

Referring now to FIG. 7 there is depicted mattress foundation 16, which is configured to accommodate a king sized mattress. The king sized mattress foundation has a greater width than the width of the twin, full, and queen sized mattresses previously described. The length of the king sized mattress foundation is similar to that of the queen sized mattress foundation. For example, a standard king sized mattress may have a width of about 75 inches and a length of about 79 inches. In this embodiment, the mattress foundation 16 includes four support units in abutment within one another to generally form a rectangular shape at each end of the foundation 16 and include a planar surface extending and supporting the entire width and length of the king sized mattress.

Because the king sized mattress foundation has a length about equal to that of the queen sized mattress foundation 14 and has a width that is about twice that of the twin sized mattress foundation 10, the king sized mattress foundation can be configured with many of the same components used to form the twin and queen sized mattress foundations 10 and 14, respectively. The king sized mattress foundation includes two support units 100 and two intermediate support units 140. Support units 100 are defined by pairs of end units 22, 24 and planar support surface 27 as previously described and shown in FIGS. 5 and 6. Support units 140 include end units 42 and 44 that were previously described in FIG. 2 as it relates to the twin sized mattress. However, because the length differs, support unit 140 includes planar surface support 146 spanning a pair of end units 42, 44. The support units 100 and 140 are abutting arranged as shown to form a generally rectangular shape at each end of the foundation 16.

Alternatively, mattress foundation 16 can be formed using three pieces as described in relation to mattress foundation 14, wherein one or more of the two support units and intermediate support unit provide an increased dimension to accommodate the overlying king sized mattress.

Optionally, the end units in any of the embodiments disclosed herein may further include casters to permit rolling of the assembled mattress foundation as may be desired for some applications. Likewise, the end units may further include flanges for attachment of a headboard. Also, it should be apparent that the various components may include ribbing as well as structure supports integral to and/or attached to a selected one of the end units and planar surface supports described above.

As demonstrated above, because the various sized beds typically have common lengths for multiple mattress sizes, the foundation inventory still remains relatively small since at least some of the end units and planar surface supports can be retained for use in all of the different sizes of the mattress foundations. Moreover, packaging size requirements are minimized since the mattress foundation is a composite of numerous components that are relatively small in size or can be stackedly arranged to minimize space requirements.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A multi-piece mattress foundation for supporting a mattress comprising:

two support units in an abutting relationship that form a rectangular shape at each end of the mattress foundation and provide an elevated planar support surface having length and width dimensions effective to support a mattress disposed thereon, wherein the multi-piece mattress foundation is free of springs, wherein the two support units are mirror images of one another and collectively form the elevated planar surface support, wherein each support unit comprises opposing end units and a planar surface support extending therebetween, the opposing end units having a quadrilateral cross sectional shape defined by a vertical support sidewall, an angled support sidewall, and parallel support walls extending therebetween.

2. The multi-piece mattress foundation of claim 1, further comprising a container for containing the pair of opposing end units corresponding to each one of the support units, and a container for containing the planar surface supports, wherein the end unit container and the planar surface support container are dimensioned for shipment in an over the highway vehicle.

3. The multi-piece mattress foundation of claim 1, wherein the pair of opposing end units and the planar surface support are formed of a plastic.

4. The multi-piece mattress foundation of claim 1, wherein the pair of opposing end units and the planar surface support are formed of a biocomposite resin.

5. The multi-piece mattress foundation of claim 1, wherein the quadrilateral cross sectional shape of the opposing end units is selected from the group consisting of a trapezoidal cross sectional shape and a isosceles trapezoidal cross sectional shape.

6. The multi-piece mattress foundation of claim 1, wherein the each one of the opposing end units comprise a vertical support sidewall, the angled support sidewall, and parallel support walls extending there between.

7. The multi-piece mattress foundation of claim 1, wherein the elevated planar support surface comprises at least one opening.

8. The multi-piece mattress foundation of claim 1, wherein the two support units each comprise one or more components that are sized for shipment in a container and for transportation in an over the highway vehicle.

9. A mattress foundation for supporting a mattress comprising:

two end support units and at least one intermediate support unit disposed therebetween in an abutting relationship that form a rectangular shape at each end of the mattress foundation and provide a planar support surface having length and width dimensions effective to support a mattress disposed thereon, wherein each end support unit comprises opposing end units and a planar support surface extending therebetween, wherein each of the opposing end units comprises a quadrilateral shape having a vertical support sidewall, an angled support sidewall, and parallel support walls extending therebetween, and wherein the at least one intermediate support unit comprises opposing end units having a quadrilateral shape and a planar support surface extending therebetween, wherein each of the opposing end units have at least one angled support sidewall that abuts the angled wall correspond to one of the two end support units.

10. The mattress foundation of claim 9, wherein the at least one intermediate support unit is defined by two intermediate support units in abutting relationship to form the rectangular shape at each end of the mattress foundation, each of the two intermediate support units having opposing end units the quadrilateral shape of the two support end units, wherein the outer two support units and the two intermediate support units are oriented such that the planar surface supports of the two outer support units have a greater width dimension than the two intermediate support units.

11. The mattress foundation of claim 9, further comprising a container for containing the pair of opposing end units corresponding to one of the support units, and a container for containing the planar surface supports, wherein the end unit container and the planar surface support container are dimensioned for shipment in an over the highway vehicle.

12. The support unit of claim 11, wherein the end units have arcuate corners.

13. The mattress foundation of claim 9, wherein each one of the opposing end units of the at least one intermediate support unit comprise a trapezoidal cross sectional shape.

14. The mattress foundation of claim 9, wherein each one of the opposing end units of the two end support units further comprise a caster disposed on a bottom surface of the end unit when assembled.

15. The mattress foundation of claim 9, further comprising a container for containing the first and second end units, and a container for containing the planar surface support, wherein the end unit container and the planar surface support container are dimensioned for shipment in an over the highway vehicle.

16. The mattress foundation of claim 9, wherein the abutting relationship of the two end support units configure the vertical support walls of the end units to face outwardly and the angled support sidewalls to face internally to the foundation.

17. The mattress foundation of claim 9, further comprising a spacer member intermediate abutting support units, wherein the spacer member is configured to minimize a gap between the abutting support units.

18. The mattress foundation of claim 9, further comprising a spacer member intermediate abutting planar support surfaces of the support units, wherein the spacer member is configured to minimize a gap between the abutting support units and extends along the length dimension of the mattress foundation.

19. The mattress foundation of claim 9, wherein the two support end units and at least one intermediate support unit are formed of plastic.

20. The mattress foundation of claim 9, wherein the two support end units and at least one intermediate support unit are formed of a biocomposite resin.

21. The mattress foundation of claim 9, wherein the two support end units and the at least one intermediate support unit further comprise an slip resistant coating or pad disposed on the corresponding planar support surface and configured to contact the mattress disposed thereon.

22. The mattress foundation of claim 9, wherein the support units further comprise a textured planar support surface and configured to contact the mattress disposed thereon.

23. The mattress foundation of claim 9, wherein the planar support surfaces of the two support units define a recessed region configured to receive the mattress disposed thereon.

24. The mattress foundation of claim 9, wherein the two support units are substantially of the same dimension and shape.

25. The mattress foundation of claim 9, wherein the at least one intermediate support unit is defined by a single support unit, wherein each of the opposing end units has an isosceles trapezoidal cross sectional shape.

26. A support unit for a mattress foundation, the support unit comprising:

a first end unit comprising a quadrilateral cross sectional shape defined by a vertical support sidewall, an angled support sidewall, and parallel support walls extending therebetween;

a second end unit spaced apart from the first end unit that is a mirror image of the first end unit; and a planar surface support coupled to and spanning a distance between the first and second end units and configured to provide an elevated support surface for supporting a mattress, wherein the first and second end units are spaced apart at a distance about equal to a length dimension of a mattress to be disposed on the mattress foundation when assembled.

27. The support unit of claim 26, wherein the quadrilateral cross sectional shape of the first and second end units is selected from the group consisting of a trapezoidal cross sectional shape and a isosceles trapezoidal cross sectional shape.

28. The support unit of claim 26, wherein the first and second end units comprise a caster disposed on a bottom surface of the end unit when assembled.

29. The support unit of claim 26, wherein the first and second end units are formed of a plastic.

30. The support unit of claim 26, wherein the first and second end units are formed of a biocomposite resin.

31. The support unit of claim 26, wherein a selected one of the parallel support walls that is selected to elevate a mattress disposed thereon comprises a flange for attachment of the planar surface support thereto.

* * * * *